US010494688B2

(12) United States Patent
Nakano

(10) Patent No.: US 10,494,688 B2
(45) Date of Patent: Dec. 3, 2019

(54) HOT-WORKING TOOL AND MANUFACTURING METHOD THEREFOR

(71) Applicant: HITACHI METALS, LTD., Tokyo (JP)

(72) Inventor: Yousuke Nakano, Yasugi (JP)

(73) Assignee: HITACHI METALS, LTD., Tokyo (JP)

( * ) Notice: Subject to any disclaimer, the term of this patent is extended or adjusted under 35 U.S.C. 154(b) by 255 days.

(21) Appl. No.: 15/533,550

(22) PCT Filed: Feb. 2, 2016

(86) PCT No.: PCT/JP2016/053019

§ 371 (c)(1),
(2) Date: Jun. 6, 2017

(87) PCT Pub. No.: WO2016/136401

PCT Pub. Date: Sep. 1, 2016

(65) Prior Publication Data

US 2017/0342517 A1 Nov. 30, 2017

(30) Foreign Application Priority Data

Feb. 25, 2015 (JP) ..... 2015-035314

(51) Int. Cl.
*B21D 37/01* (2006.01)
*B21D 37/20* (2006.01)
(Continued)

(52) U.S. Cl.
CPC ..... *C21D 8/005* (2013.01); *B21D 37/01* (2013.01); *B21D 37/20* (2013.01); *B21J 13/02* (2013.01);
(Continued)

(58) Field of Classification Search
CPC ..... B21D 37/01; B21D 37/20; B21J 13/02; C21D 1/18; C21D 6/002; C21D 6/005;
(Continued)

(56) References Cited

U.S. PATENT DOCUMENTS 2,985,529 A * 5/1961 Harris ..... C22C 38/12 420/37
3,132,937 A * 5/1964 Sadowski ..... C22C 38/105 148/328
(Continued)

FOREIGN PATENT DOCUMENTS

EP 3150735 A1 4/2017
JP 02-179848 A 7/1990
(Continued)

OTHER PUBLICATIONS

Jia Shu jun et al., "Research on Influence of Phosphorous and Grain Size on Mechanical Properties of Low Carbon Steels", Iron and Steel, Jun. 2005, vol. 40, No. 6, pp. 59-63 (5 pages).
(Continued)

*Primary Examiner* — Cam N. Nguyen
(74) *Attorney, Agent, or Firm* — Sughrue Mion, PLLC

(57) ABSTRACT

Provided is a hot-working tool capable of maintaining adequate toughness even if the permissible amount of P contained in the hot-working tool is increased. The present invention is a hot-working tool, which has a component composition that can be adjusted to a martensitic structure by quenching and has a post-quenching and tempering martensitic structure, wherein: the component composition comprises greater than 0.020 mass % to 0.050 mass % of P; prior austenite grain diameter in said post-quenching and tempering martensitic structure is at least No. 9.5 in grain size number according to JIS-G-0551; and the P concentration of the grain boundary of said prior austenite particles is not more than 1.5 mass %. A hot-working tool wherein said
(Continued)

component composition also comprises not more than 0.0250 mass % of Zn is preferable. The present invention also is a method for manufacturing a hot-working tool in which quenching and tempering are performed on a hot-working tool material with said component composition.

6 Claims, 5 Drawing Sheets

(51) Int. Cl.

| | |
|---|---|
| ***C21D 1/18*** | (2006.01) |
| ***C21D 6/00*** | (2006.01) |
| ***C21D 9/00*** | (2006.01) |
| ***C22C 38/00*** | (2006.01) |
| ***C22C 38/02*** | (2006.01) |
| ***C22C 38/04*** | (2006.01) |
| ***C22C 38/22*** | (2006.01) |
| ***C22C 38/24*** | (2006.01) |
| ***C22C 38/26*** | (2006.01) |
| ***C22C 38/30*** | (2006.01) |
| ***C22C 38/34*** | (2006.01) |
| ***C22C 38/40*** | (2006.01) |
| ***C21D 8/00*** | (2006.01) |
| ***B21J 13/02*** | (2006.01) |
| *B22D 17/22* | (2006.01) |

(52) U.S. Cl.
CPC ..... *C21D 1/18* (2013.01); *C21D 6/002* (2013.01); *C21D 6/005* (2013.01); *C21D 6/008* (2013.01); *C22C 38/002* (2013.01); *C22C 38/02* (2013.01); *C22C 38/04* (2013.01); *C22C 38/22* (2013.01); *C22C 38/24* (2013.01); *C22C 38/26* (2013.01); *C22C 38/30* (2013.01); *C22C 38/34* (2013.01); *C22C 38/40* (2013.01); *B22D 17/22* (2013.01); *C21D 2211/001* (2013.01); *C21D 2211/008* (2013.01)

(58) Field of Classification Search
CPC ..... C21D 6/008; C21D 9/00; C22C 38/00; C22C 38/002; C22C 38/02; C22C 38/04; C22C 38/22; C22C 38/24; C22C 38/26; C22C 38/30; C22C 38/34; C22C 38/40
See application file for complete search history.

(56) References Cited

U.S. PATENT DOCUMENTS

| | | | | |
|---|---|---|---|---|
| 5,650,024 | A * | 7/1997 | Hasegawa | C21D 6/002 148/326 |
| 6,464,804 | B2 * | 10/2002 | Goecmen | C21D 6/004 148/325 |
| 8,083,990 | B2 * | 12/2011 | Ishida | C21D 8/0205 148/320 |
| 8,168,008 | B2 * | 5/2012 | Miyata | C21D 1/25 148/325 |
| 8,607,941 | B2 * | 12/2013 | Yamauchi | C21D 6/002 148/325 |
| 9,873,930 | B2 * | 1/2018 | Oikawa | C21D 6/00 |
| 2002/0003008 | A1 * | 1/2002 | Goecmen | C21D 6/004 148/325 |
| 2004/0047757 | A1 | 3/2004 | Takayama | |
| 2006/0054253 | A1 * | 3/2006 | Fujitsuna | C21D 1/18 148/609 |
| 2015/0027598 | A1 * | 1/2015 | Seng | A61L 31/022 148/578 |
| 2016/0130711 | A1 * | 5/2016 | Fujita | C21D 8/0226 148/504 |
| 2016/0348202 | A1 | 12/2016 | Nakano | |

FOREIGN PATENT DOCUMENTS

| | | | |
|---|---|---|---|
| JP | 2000-119818 | A | 4/2000 |
| JP | 2000-328196 | A | 11/2000 |
| JP | 2003-268486 | A | 9/2003 |
| JP | 2003-328078 | A | 11/2003 |
| JP | 2005-082813 | A | 3/2005 |
| JP | 2007-224418 | A | 9/2007 |
| JP | 2010-031366 | A | 2/2010 |
| JP | 2013-032576 | A | 2/2013 |
| JP | 2013-082992 | A | 5/2013 |

OTHER PUBLICATIONS

International Search Report of PCT/JP2016/053019 dated Apr. 26, 2016 [PCT/ISA/210].
Communication dated Jun. 14, 2018, from the European Patent Office in counterpart European Application No. 16755151.4.

* cited by examiner

HOT-WORKING TOOL AND MANUFACTURING METHOD THEREFOR

CROSS REFERENCE TO RELATED APPLICATIONS

This application is a National Stage of International Application No. PCT/JP2016/053019, filed Feb. 2, 2016 (claiming priority based on Japanese Patent Application No. 2015-035314, filed Feb. 25, 2015), the contents of which are incorporated herein by reference in their entirety.

TECHNICAL FIELD

The present invention relates to various hot-working tools, such as a press die, a forging die, a die casting die, and an extrusion tool, and to a manufacturing method therefor.

BACKGROUND ART

Hot-working tools are required to have toughness to endure impacts since they are used in contact with a hot-temperature workpiece and a hard workpiece. Conventionally, alloy tool steels such as SKD61, which is a JIS steel grade, have been used for hot-working tool materials. Moreover, in response to recent demands for further improvement in toughness, alloy tool steel materials having an improved component composition of the SKD61 alloy tool steel have been proposed for the hot-working tool material (see Patent Literatures 1, 2).

Typically, a hot-working tool is fabricated by machining a hot-working tool material, which is in an annealed state and has a low hardness, into a shape of a hot-working tool, and thereafter subjecting it to quenching and tempering to adjust it to have a predetermined hardness for use. Moreover, after the adjustment to the above described hardness for use, the hot-working tool is typically subjected to finish machining. In some cases, the above described hot-working tool material is first subjected to quenching and tempering (formed into a state of so-called pre-hardened material), and thereafter is subjected to machining into a shape of the hot-working tool in junction with the above described finish machining. Quenching is an operation in which the hot-working tool material in an annealed state (or the hot-working tool material after it is machined) is heated to and held in an austenite temperature region, and thereafter rapidly cooled to cause its structure to transform into martensite. Therefore, the component composition of the hot-working tool material is adjusted such that it can obtain a martensitic structure by quenching.

Thus, in the martensitic structure after quenching, grain boundaries of austenite crystal which have been produced in the process of heating and holding the material to and in the above described austenite temperature region are recognizable as "prior austenite grain boundaries". The distribution state of the "prior austenite grain diameter" formed by the prior austenite grain boundaries is substantially maintained even in the metal structure after subsequent tempering (that is, the structure of a completed hot-working tool).

Meanwhile, in an aspect of such hot-working tool, it is known that the toughness of the hot-working tool can be improved by reducing the contents of inevitable impurities contained in its component composition, such as P, S, O, and N. Amongst those, P segregates at prior austenite grain boundaries of the martensitic structure after quenching and tempering, thereby embrittling the grain boundaries and significantly reducing the toughness of the hot-working tool.

Thus, a hot-working tool material (that is, a hot-working tool) in which P content is limited to not more than 0.020 mass % has been proposed (Patent Literature 3). It is also known that the toughness of a hot-working tool can be improved by reducing prior austenite grain diameter in the above described martensitic structure (Patent Literature 3).

CITATION LIST

Patent Literature

Patent Literature 1: JP-A-02-179848
Patent Literature 2: JP-A-2000-328196
Patent Literature 3: JP-A-2003-268486

SUMMARY OF INVENTION

Technical Problem

Reducing the P content contained in a hot-working tool is very effective in the improvement of the toughness of the hot-working tool after quenching and tempering. However, removing P in a hot-working tool material by a smelting process, etc. will consume large energy. Further, removing P by this smelting process, etc. has been a factor to cause delay in the promotion of usage of low grade iron scrap of high P content. In this way, P to be reduced is an element which imposes a large load on the environment in the field of hot-working tools.

It is an objective of the present invention to provide a hot-working tool which can maintain sufficient toughness even if a permissive amount of P content contained in the hot-working tool is increased.

Solution to Problem

The present invention is a hot-working tool having a component composition which can obtain a martensitic structure by quenching, and having a martensitic structure after quenching and tempering, wherein the component composition contains more than 0.020 mass % and not more than 0.050 mass % of P, a grain diameter of a prior austenite crystal in the martensitic structure after quenching and tempering is not less than No. 9.5 in a grain size number according to JIS-G-0551, and a P concentration at a grain boundary of the prior austenite crystal is not more than 1.5 mass %.

Preferably, in the hot-working tool, the component composition further contains not more than 0.0250 mass % of Zn.

Further, the present invention is a method for manufacturing a hot-working tool having a martensitic structure in which a hot-working tool material having a component composition which can obtain a martensitic structure by quenching is subjected to quenching and tempering, wherein the component composition of the hot-working tool material contains more than 0.020 mass % and not more than 0.050 mass % of P, a grain diameter of prior austenite crystal in the martensitic structure after quenching and tempering is not less than No. 9.5 in a grain size number according to JIS-G-0551, and a P concentration at a grain boundary of the prior austenite crystal is not more than 1.5 mass %.

Preferably, in the manufacturing method for a hot-working tool, the component composition of the hot-working tool material further contains not more than 0.0250 mass % of Zn.

Advantageous Effects of Invention

According to the present invention, it is possible to maintain sufficient toughness of a hot-working tool containing more than 0.020 mass % and not more than 0.050 mass % of P.

DESCRIPTION OF EMBODIMENTS

Figure 1:
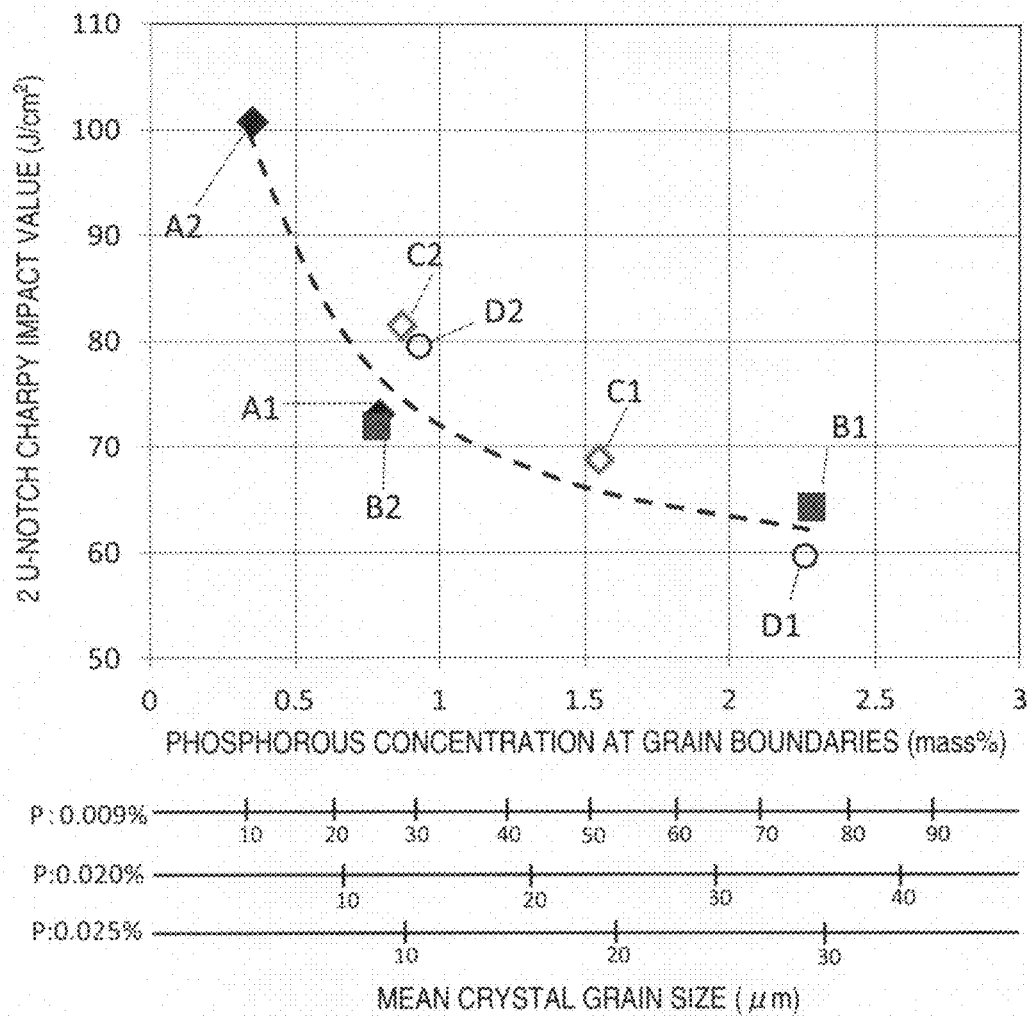
FIG. 1 is a graph showing a relationship between Charpy impact values and P concentrations at prior austenite grain boundaries for a hot-working tool made of SKD61 (quenched and tempered hardness: 43 HRC).

The present inventor investigated a technique to maintain sufficient toughness of a hot-working tool even if P content contained in the hot-working tool material is high. As a result, the inventor has found that adjusting the prior austenite grain diameter "directly" functions to suppress P segregation at prior austenite grain boundaries in connection with that one of the factors to degrade the toughness of a hot-working tool caused by P contained therein is P segregation at prior austenite grain boundaries in a martensitic structure after quenching and tempering. Then, as a result of that a specific relative amounts between the "P permissible amount," at which a "suppressing effect against P segregation" at the prior austenite grain boundaries is sufficiently exhibited, thereby allowing to maintain sufficient toughness of a hot-working tool even if P content is high, and the "prior austenite grain diameter" can be made clear, the inventor completed the present invention. Hereinafter, each configuration requirement of the present invention will be described.

(1) The hot-working tool of the present invention "has a component composition which can obtain a martensitic structure by quenching, and has a martensitic structure after quenching and tempering."

Generally, a hot-working tool is fabricated by subjecting a hot-working tool material in an annealed state to quenching and tempering. Such a hot-working tool material having an annealed structure is produced in such a way that a raw material made up of a steel ingot or a billet bloomed from the steel ingot is subjected as a starting material to various hot working and heat treatments to obtain a predetermined steel material, and the steel material is subjected to annealing treatment and is finished into, for example, a block shape. As described above, conventionally, a raw material which transforms into a martensitic structure by quenching and tempering has been used for a hot-working tool material. The martensitic structure is necessary for the basis of absolute toughness of various hot-working tools. Typical raw materials for such hot-working tools (that is, hot-working tool materials) include, for example, various hot-working tool steels. A hot-working tool steel is used under an environment where the surface temperature of the steel is raised to not less than about 200° C. Typical component compositions applicable to such hot-working tool steel include those of, for example, standard steel grades in JIS-G-4404 "alloy tool steels" and other proposed materials. In addition, elements that are not specified in the hot-working tool steels can be added and contained as needed.

Provided that an annealed structure of the raw material transforms into a martensitic structure by being quenched and tempered, the above described "suppressing effect against P segregation" of the present invention can be achieved just by the quenched and tempered structure satisfying a below described requirement (3). Accordingly, except setting a "permissible value (lower limit value)" of the P content of a hot-working tool for achieving a meaningful suppressing effect against P segregation of the present invention, there is no need of specifying the component composition of the above described raw material for achieving the above described effect of the present invention.

However, for basing absolute mechanical properties of the hot-working tool, it is preferable that the raw material has a component composition of a hot-working tool steel containing, in mass %, C: 0.30 to 0.50% and Cr: 3.00 to 6.00%, and further containing P to be described below as a component composition which allows formation of the above described martensitic structure. Further, for improving absolute toughness of a hot-working tool, it is preferable that the raw material has a component composition of a hot-working tool steel further containing V: 0.10 to 1.50%. Alternatively, when Mo or W is contained, it is preferable for improving absolute toughness of a hot-working tool that the raw material has a component composition of a hot-working tool steel containing one of both of Mo and W in an amount of (Mo+½W): not more than 3.50%. At this moment, for imparting strength and softening resistance to a hot-working tool, it is more preferable that the above described value of (Mo+½W) is not less than 0.50%.

Specifically, the raw material preferably has a component composition containing: C: 0.30 to 0.50%, Si: not more than 2.00%, Mn: not more than 1.50%, S: not more than 0.0500%, Cr: 3.00 to 6.00%, one or both of Mo and W in an amount of (Mo+½W): 0.50 to 3.50%, and V: 0.10 to 1.50%, and further containing P to be described below. Increasing a basic toughness value of a hot-working tool has a synergy with the suppressing effect against P segregation of the present invention, making it possible to obtain a hot-working tool having more excellent toughness. Hereinafter, various elements which can constitute a component composition of a hot-working tool of the present invention will be described as follows.

C: 0.30 to 0.50% in Mass % (Hereinafter, Simply Expressed as "%")

Carbon (C) is a basic element of a hot-working tool, which partly solid-solves into a matrix to strengthen it, and partly forms carbides to enhance wear resistance and seizure resistance thereof. Furthermore, when added together with a substitutional atom having high affinity to carbon, such as Cr, the carbon solid-solved as an interstitial atom is expected to have an I (interstitial atom)-S (substitutional atom) effect (in which carbon acts as a drag resistance of a solute atom, thereby strengthening the hot work tool). However, excessive addition of carbon causes deterioration of toughness and high temperature strength. Therefore, the carbon content is preferably 0.30 to 0.40%. It is more preferably not less than 0.34%. It is more preferably not more than 0.40%.

Si: Not More than 2.00%

While Si is a deoxidizing agent during steel making, excessive Si causes production of ferrite in the tool structure after quenching and tempering. Therefore, the Si content is preferably not more than 2.00%. It is more preferably not more than 1.00%. It is furthermore preferably not more than 0.50%. On the other hand, Si has an effect of enhancing machinability of materials. In order to obtain this effect, addition of not less than 0.20% is preferable. Addition of not less than 0.30% is more preferable.

Mn: Not More than 1.50%

Excessive Mn increases viscosity of the matrix, thereby reducing machinability of materials. Therefore, the content of Mn is preferably not more than 1.50%. It is more preferably not more than 1.00%. It is furthermore preferably not more than 0.75%. On the other hand, Mn has effects of enhancing hardenability and suppressing production of ferrite in the tool structure, thereby obtaining appropriate quenched and tempered hardness. Furthermore, Mn may be present as MnS which is a non-metallic inclusion and has a significant effect in improving machinability. In order to obtain these effects, addition of Mn is preferably not less than 0.10%. Addition of not less than 0.25% is more preferable. Addition of not less than 0.45% is furthermore preferable.

S: Not More than 0.0500%

Sulfur (S) is an element that can be inevitably included in various hot-working tools even though it is not intentionally added. It deteriorates hot workability of the raw material of a hot-working tool, and causes a crack in the raw material during hot working. Accordingly, to improve the hot workability, the content of S is preferably limited to not more than 0.0500%. On the other hand, S may be combined with Mn to be present as MnS, which is a non-metallic inclusion, thereby exhibiting an effect of improving machinability. In order to obtain this effect, addition of not less than 0.0300% is preferable.

Cr: 3.00 to 6.00%

Cr is an element which enhances hardenability, and forms a carbide thus exhibiting effects of improving the strength and wear resistance of the matrix. Also, Cr is a basic element of hot-working tools, which also contributes to improvement of temper softening resistance and high temperature strength. However, excessive addition of Cr rather reduces high temperature strength. It also causes deterioration of hardenability. Therefore, the Cr content is preferably 3.00 to 6.00%. It is more preferably not more than 5.50%. It is more preferably not less than 3.50%. It is furthermore preferably not less than 4.00%. It is particularly preferably not less than 4.50%.

One or Both of Mo and W in an Amount of (Mo+½W): 0.50 to 3.50%

Mo and W are elements that cause fine carbides to precipitate or aggregate in the structure through tempering, thereby imparting strength and softening resistance to hot-working tools. Mo and W can be added solely or in combination. In this regard, the amount of addition can be specified together by a Mo equivalent defined by an expression of (Mo+½W) since W has an atomic weight about twice that of Mo. As a matter of course, either only one of them may be added, or both of them may be added together. In order to achieve the above described effects, addition of not less than 0.50% in the value of (Mo+½W) is preferable. It is more preferably not less than 1.50%. It is further preferably not less than 2.50%. However, since excessive addition causes deterioration of machinability and toughness, addition of not more than 3.50% in the value of (Mo+½W) is preferable. It is more preferably not more than 2.90%.

V: 0.10 to 1.50%

Vanadium forms a carbide and thereby exhibits effects of strengthening the matrix and improving wear resistance and temper softening resistance. Furthermore, the vanadium carbide distributed in an annealed structure functions as a "pinning particle" which suppresses coarsening of austenite crystal grains during heating for quenching, thereby contributing to improvement of toughness. In order to obtain these effects, addition of not less than 0.10% is preferable. It is more preferably not less than 0.30%. It is furthermore preferably not less than 0.50%. However, since an excessive addition causes deterioration of machinability and also deterioration of toughness due to increase in the amount of carbide itself, it is preferably not more than 1.50%. It is more preferably not more than 1.00%. It is furthermore preferably not more than 0.70%.

The component composition of a hot-working tool of the present invention may be a component composition of a steel containing the above described element species and also containing P to be described later. It may also contain the above described element species, and also contains P to be described later with the balance being Fe and impurities. Further, other than the above described element species, the following element species may be contained.

Ni: 0% to 1.00%

Ni is an element that increases viscosity of the matrix, thereby reducing its machinability. Therefore, the Ni content is preferably not more than 1.00%. It is more preferably less than 0.50%, and furthermore preferably less than 0.30%. On the other hand, Ni is an element that suppresses production of ferrite in the tool structure. Furthermore, Ni, as well as C, Cr, Mn, Mo, W, etc., is also an effective element for imparting excellent hardenability to a tool material, and for preventing deterioration of toughness by forming a structure mainly composed of martensite even when the cooling rate in quenching is low. Furthermore, since Ni also improves essential toughness of the matrix, it may be added as needed in the present invention. When added, addition of not less than 0.10% is preferable.

Co: 0% to 1.00%

Since Co reduces toughness of a hot-working tool, the Co content is preferably not more than 1.00%. On the other hand, Co forms a protective oxide film which is very dense and has good adhesion to a surface of the hot-working tool during heating in the use of the hot-working tool. The oxide film prevents metal contact with a counterpart material, and suppresses temperature rise on a tool surface, thereby providing excellent wear resistance. Therefore, Co may be added as needed. When added, addition of not less than 0.30% is preferable.

Nb: 0% to 0.30%

Since Nb causes deterioration of machinability, the Nb content is preferably not more than 0.30%. On the other hand, Nb forms carbides and has effects of strengthening the matrix and improving wear resistance. Furthermore, Nb has effects of enhancing temper softening resistance, and suppressing coarsening of crystal grains to contribute to improvement in toughness, in the same manner as V. Therefore, Nb may be added as needed. When added, addition of not less than 0.01% is preferable.

In the component composition of a hot-working tool of the present invention, Cu, Al, Ca, Mg, O (oxygen) and N (nitrogen) are elements that may possibly remain in steel as inevitable impurities. Contents of these elements are preferably as low as possible in the present invention. However, on the other hand, small amounts thereof may be contained in order to obtain additional working effects such as morphological control of inclusions, improvements of other mechanical properties, and manufacturing efficiency. In this regard, ranges of Cu≤0.25%, Al≤0.025%, Ca≤0.0100%, Mg≤0.0100%, O≤0.0100%, and N≤0.0300% are sufficiently acceptable, providing preferable upper limits of the present invention.

(2) The hot-working tool of the present invention contains "more than 0.020% and not more than 0.050% of P" in the above described component composition.

One of the factors to degrade the toughness of a hot-working tool is P segregation at prior austenite grain boundaries in a martensitic structure caused by P contained therein as described above. Therefore, in the case of a conventional hot-working tool, the P content has been limited to, for example, not more than 0.020% (Patent Literature 3). However, under such background, if the toughness of a hot-working tool can be maintained at a conventional level even when the permissible value of P content is increased, specifically, the P content becomes more than 0.020%, it is possible to reduce energy and the like necessary for reducing the P content, thereby reducing load imposed on the environment. Further, improving the toughness of a hot-working tool to a level higher than before can contribute to improvement in the characteristics of the hot-working tool itself. Accordingly, the present invention has a significant meaning in that limiting its target to a hot-working tool containing "more than 0.020% of P", a technique for maintaining sufficient toughness of the hot-working tool is studied so that the above described energy and the like can be reduced. Preferably, the above described target is limited to a hot-working tool containing "not less than 0.025% of P".

However, if the P content is excessively large, the suppressing effect against P segregation of the present invention can hardly be achieved effectively. Therefore, the P content needs to be not more than 0.050%. It is preferably less than 0.040%. It is more preferably not more than 0.035%.

(3) In the hot-working tool of the present invention, "a grain diameter of prior austenite crystal is not less than No. 9.5 in the grain size number according to JIS-G-0551, and a P concentration at a grain boundary of the prior austenite crystal is not more than 1.5 mass %" in the martensitic structure thereof after quenching and tempering.

First, to grasp the degree of effect of P segregation at prior austenite grain boundaries on the toughness of a hot-working tool, the present inventor investigated the relationship between a "toughness value (for example, Charpy impact value)" which is a specific index for evaluating the toughness thereof, and a "grain boundary P concentration (that is, P concentration at prior austenite grain boundaries)" which is a specific index for evaluating P segregation. As a result, it has been found that there is a correlation between the toughness value of hot-working tool and the grain boundary P concentration, and hot-working tools, which have the same P content as a whole, may have different toughness values if they have different grain boundary P concentrations. Then, the inventor has found that a direct effect of improving toughness value of the hot-working tool can be achieved not by reducing the P content of a hot-working tool as a whole, but by targeting and reducing the above described grain boundary P concentration.

FIG. 1 is a graph showing a relationship between the Charpy impact value and the grain boundary P concentration (that is, P concentration at prior austenite grain boundaries) for a hot-working tool made of SKD61 (quenched and tempered hardness: 43 HRC). Plotted in the graph are hot-working tools A1, B1, C1, and D1, and A2, B2, C2, and D2 which are evaluated in Example to be described later. Then, scales in the bottom of the graph show the prior austenite grain diameter (mean grain diameter) when a hot-working tool having a predetermined P content as a whole (0.009%, 0.020%, and 0.025%) has various grain boundary P concentrations of the graph.

The permissible upper limit value of the P content specified in SKD61 is 0.030%. However, in a conventional hot-working tool, its P content is generally reduced to less than 0.010% in consideration of deterioration of toughness as described in Patent Literature 3. Moreover, as described in Patent Literature 3, the prior austenite grain diameter of a conventional hot-working tool is about No. 8.0 (about 20 to 30 μm in the mean grain diameter) in the grain size number according to JIS-G-0551. Then, as a result of the present inventor having investigated such conventional hot-working tools, it was found that while impact values by the 2 mm U-notch Charpy impact test were more than 70 ($J/cm^2$), grain boundary P concentrations were at a level of about less than 1.0 mass % (hot-working tool A1 of FIG. 1).

Then, the inventor has found that increasing the P content of the above described conventional hot-working tools results in decrease in toughness values of the hot-working tool in correlation with the amount of the increase. That is, in hot-working tool B1, in which while the P content of the conventional hot-working tool A1 shown in FIG. 1 was increased from "less than 0.010%" to "more than 0.020%", the prior austenite grain diameter thereof was kept at conventional "about No. 8.0 in the grain size number", the above described grain boundary P concentration increased to a level of "not less than 2.0 mass %". Then, as the grain boundary P concentration increased, the toughness value decreased to a level of lower than 70 ($J/cm^2$), and it became difficult to maintain a toughness of conventional hot-working tool A1. However, even for hot-working tool B1 having a P content of more than 0.020% and "a low toughness value", if the grain boundary P concentration can be suppressed to be not more than a conventional level, for example, "not more than 1.5 mass %", it is possible to maintain the level of toughness of a conventional hot-working tool having a P content of less than 0.020%. Preferably, the grain boundary P concentration is suppressed to be "not more than 1.0 mass %".

Then, to determine factors that influence the grain boundary P concentration of the above described hot-working tool, the present inventor investigated the relationship between the grain boundary P concentration and the prior austenite grain diameter of the hot-working tool. As a result of that, the inventor has focused on the fact that decreasing the above described prior austenite grain diameter results in increase in the volume of the prior austenite grain boundary, which is a segregation site of P, even if the P content as a whole is the same in a hot-working tool. Thus, the inventor has reached a conclusion that as the volume of prior austenite grain boundary increases, the P concentration measured at a position of the prior austenite grain boundary is diluted, thereby reducing grain boundary P concentration, that is, the suppressing effect against P segregation of the present invention is exhibited, and thus toughness is improved.

Then, as a result of studying conditions at which the suppressing effect against P segregation of the present invention is effectively exhibited when the P content as a whole exceeded 0.020% in various hot-working tools having a component composition which can obtain a martensitic structure by quenching, the inventor reached a conclusion that it is effective to make the above described prior austenite grain diameter as small as "not less than No. 9.5" in the grain size number according to JIS-G-0551. Note that as the grain size number increases, the prior austenite grain diameter decreases. And the grain size number of No. 9.5 corresponds to a mean grain diameter of about 15 μm.

FIG. 1 revealed that in a hot-working tool having a P content as a whole of more than 0.020%, when the prior austenite grain diameter is made not more than about 15 μm in the mean grain diameter (that is, not less than No. 9.5 in the grain size number), the grain boundary P concentration is suppressed to be not more than 1.5 mass %, and the Charpy impact value can be maintained at a conventional level of 70 (J/cm$^2$). Preferably, the prior austenite grain diameter is as small as not less than No. 10.0 in the grain size number. The prior austenite grain diameter of not less than No. 10.0 is particularly preferable requirement when the P content of the hot-working tool is not less than 0.025%. The grain size number according to JIS-G-0551 can be treated equivalently with the grain size number according to ASTM-E112 which is an international standard. Hereinafter, these grain size numbers will be simply denoted by "No." alone.

Note that although there is no need of setting an upper limit value for the grain size number of the prior austenite grain diameter, No. 12.0 (about 6 μm in the mean grain diameter) is a realistic value. No. 11.5 (about 7.5 μm in the mean grain diameter) is a more realistic value.

The position of a hot-working tool where the above described prior austenite grain diameter is measured may be set to a position where toughness is demanded. For example, it may be located on a working surface (surface to be in contact with a counterpart material) of various hot-working tools such as dies and jigs, and on other surfaces. Moreover, the position may be located inside various hot-working tools, and on surfaces (inner surfaces) of holes and grooves formed thereinside.

Further, in the present invention, the above described grain boundary P concentration of prior austenite crystal is measured by an Auger electron spectroscopy (AES) apparatus. When measurement is made by an X-ray photoelectron spectroscopy apparatus (EDX) and an X-ray micro analyzer (EPMA), generally, one side of a measurement region is as wide as about 1 μm, and the amount of P in the surrounding of a prior austenite grain boundary (that is, inside the grain) may be measured substantially. In this regard, when measurement is made by an Auger electron spectroscopy apparatus, one side of the above described measurement region is supposed to be about 10 nm, which is optimal to the measurement of P concentration targeted to a prior austenite grain boundary.

Figure 4:
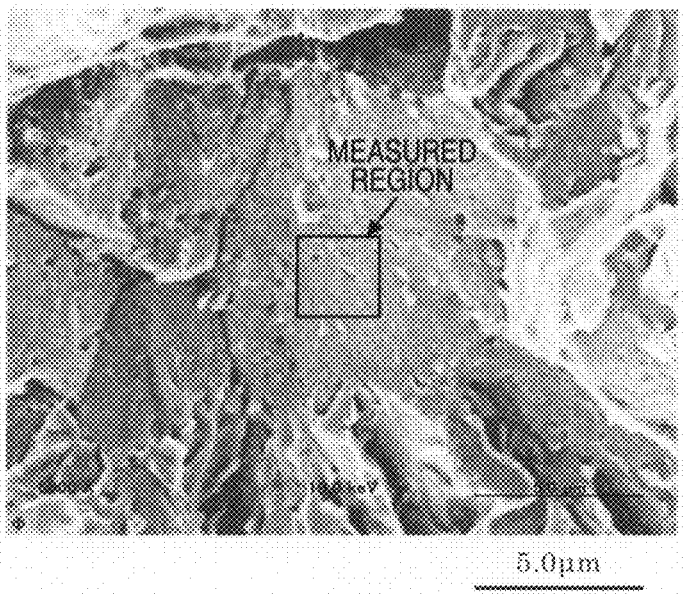
FIG. 4 is a scanning electron microscopic image of a broken-out surface structure of a hot-working tool, which shows an example of prior austenite grain boundary confirmed in the broken-out surface.
Figure 5:
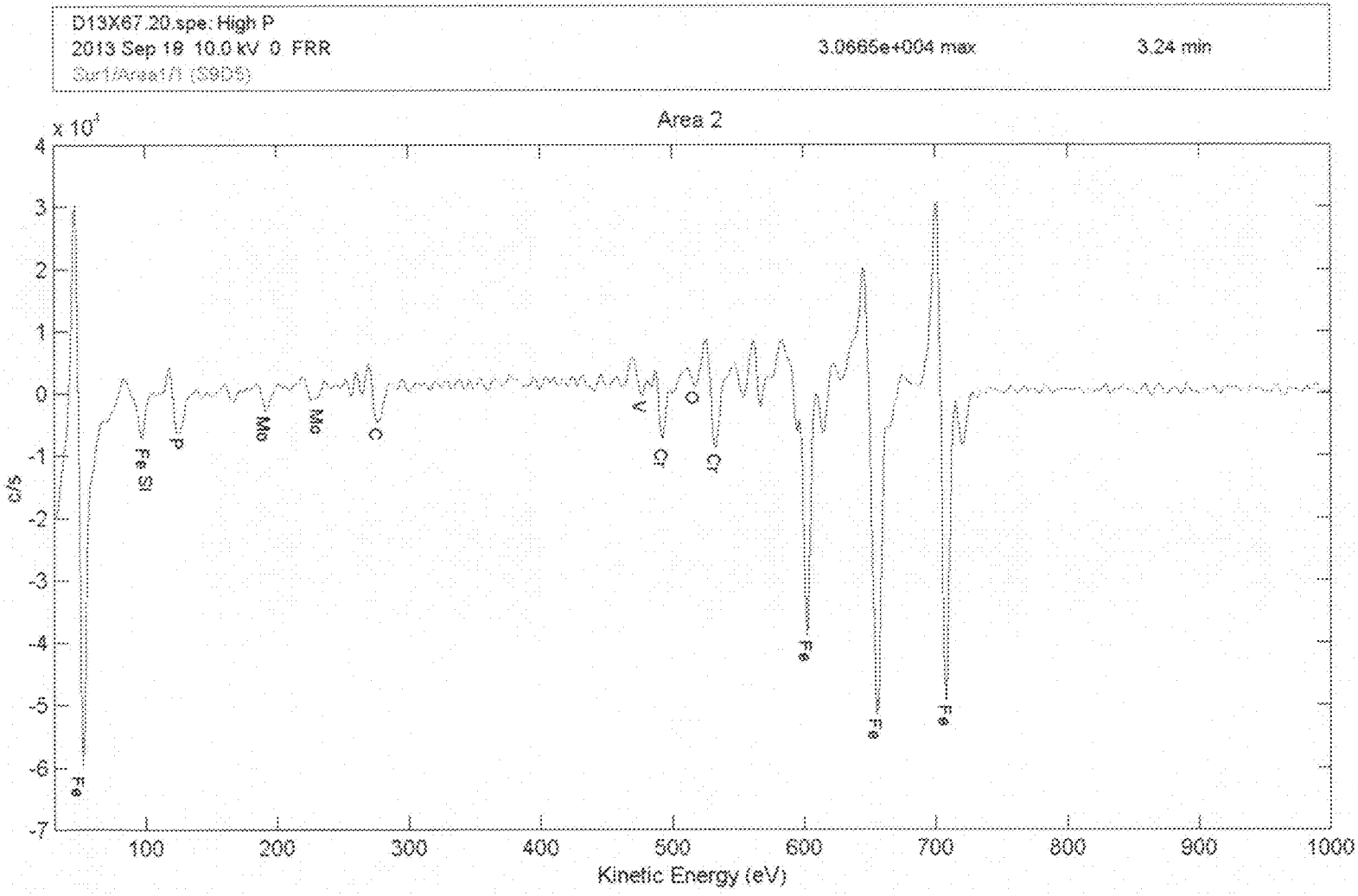
FIG. 5 is a diagram showing an example of Auger electron spectrum which is acquired when a position corresponding to prior austenite grain boundary is analyzed by an Auger electron spectroscopy apparatus in a broken-out surface of a hot-working tool.

First, a hot-working tool is intergranularly fractured at a position of the hot-working tool, where the grain boundary P concentration is to be measured, to expose a broken-out surface. Next, a position corresponding to a prior austenite grain boundary confirmed in the broken-out surface (see FIG. 4) is analyzed by the Auger electron spectroscopy apparatus to collect Auger electron spectra of each element from a measurement region having an area of 3×3 μm (see FIG. 5). Then, quantitative analysis of P concentration can be performed from an obtained peak intensity ratio of each element to obtain the above described grain boundary P concentration.

It is known that "reduction of prior austenite grain diameter", which has been conventionally performed, itself contributes to refining of martensitic structure, resulting in increase of toughness. However, the "reduction of prior austenite grain diameter" that contributes to improvement of toughness of hot-working tool in the present invention is, as described above, based on the effect of diluting P segregated at prior austenite grain boundaries, and different from the effect by simple "refining of martensitic structure".

Note that generally, it is not easy to reduce the above described prior austenite grain diameter to not less than No. 13.0 in a hot-working tool after quenching and tempering. Thus, while reduction of the prior austenite grain diameter is not easy, if only the P content as a whole increases, there is a limit on the dilution of P concentration at prior austenite grain boundaries, and the suppressing effect against P segregation of the present invention becomes less likely to be exhibited. As a result, for example, it becomes difficult to maintain the above described level of Charpy impact value of 70 (J/cm$^2$). Therefore, the upper limit of P which can be contained in a hot-working tool of the present invention is specified to be 0.050%.

(4) Preferably, a hot-working tool of the present invention "further contains not more than 0.0250% of Zn" in the component composition.

Zn is an element that can improve toughness of a hot-working tool by being contained in a hot-working tool having the component composition explained in the above described (1) and (2). This can compensate for deterioration of toughness due to increase of P content. The content is preferably more than 0.0025% so that the effect of improving toughness can be sufficiently achieved. More preferably, it is not less than 0.0030%.

However, when Zn is excessively contained, extreme segregation of Zn occurs at prior austenite grain boundaries or the like, which can be a factor to cause deterioration of toughness. Then, even when Zn is contained, the upper limit thereof is preferably 0.0250%. It is more preferably not more than 0.0200%, and further preferably not more than 0.0150%.

(5) The method for manufacturing a hot-working tool of the present invention performs "quenching and tempering" on the hot-working tool material having a component composition explained in the above described (1), (2), and (4).

The hot-working tool material to be used for the manufacturing for a hot-working tool of the present invention is prepared as a martensitic structure imparted with a predetermined hardness by quenching and tempering, and is made into a product of hot-working tool. Then, the above described hot-working tool material is made into a shape of a hot-working tool by various machining such as cutting and drilling. The above described machining is preferably performed at a timing before quenching and tempering, and in a state in which the hardness of the material is low (that is, annealed state). In this case, finish machining may be performed after quenching and tempering. Further, in some cases, a material in a state of a pre-hardened material after being subjected to quenching and tempering may be machined into a shape of a hot-working tool all at once including the above described finish machining.

Although the temperatures of the above described quenching and tempering vary depending on the component composition and target hardness and the like of raw material, the quenching temperature is preferably about 1000 to 1100° C., and the tempering temperature is preferably about 500 to 650° C. For example, in the case of SKD61 which is a representative steel grade of hot-working tool steels, the quenching temperature is about 1000 to 1030° C., and the tempering temperature is about 550 to 650° C. The quenched and tempered hardness is preferably not more than 50 HRC. It is preferably 40 to 50 HRC. It is more preferably not more than 48 HRC.

Further, to achieve the effect of "diluting P segregated at prior austenite grain boundaries" further efficiently, in addition to the above described "reduction of prior austenite grain diameter", it is effective to perform homogenizing treatment at a high temperature of 1200 to 1350° C. for long hours (for example, not less than 10 hours) on the raw material before hot working. The temperature of this homogenizing treatment is preferably not less than 1230° C. Moreover, it is preferably not more than 1300° C., and more preferably not more than 1270° C.

Then, as the above described hot working after performing the above described homogenizing treatment, it is effective to perform solid forging with a processing ratio (cross-sectional area ratio) of not less than 7S ("S" is a symbol to indicate solid forging). Solid forging means hot working in which a solid (that is, the above described raw material) is forged to reduce its cross-sectional area, and increase its length. Then, it is preferable to arrange that a "forging ratio" which is represented by a ratio A/a between a cross-sectional area "A" of a cross section of the raw material which is to be reduced in the cross-sectional area by the hot working, and a cross-sectional area "a" of the cross section which has been reduced after the hot working is "not less than 7S" as described above. Then, it is effective to finish the hot working in a short actual working time without performing reheating during this hot working.

The above described homogenizing treatment at a high temperature for long hours can change nonuniform distribution of P caused by a solidification structure of the raw material into a uniform distribution. Further, the above described hot working with a high processing ratio can refine the austenite grain diameters which have been coarsened by the homogenizing treatment. Then, just after hot working is finished, it is possible to increase the segregation sites of P in the structure, thereby suppressing P from segregating again during cooling after hot working. These conditions allow to more effectively suppress concentration of P at prior austenite grain boundaries after quenching and tempering.

Example

Raw materials A, B, C, and D (thickness 70 mm×width 70 mm×length 100 mm) made of hot-working tool steel SKD61 which was a specified steel grade of JIS-G-4404 and had component compositions of Table 1 were prepared. Note that raw material A was a conventional material in which P content was reduced to less than 0.010%. In all the raw materials, Cu, Al, Ca, Mg, O, and N were not added (here, a case in which Al was added as a deoxidizing agent in melting process was included), and were included in the following amounts: Cu≤0.25%, Al≤0.025%, Ca≤0.0100%, Mg≤0.0100%, O≤0.0100%, and N≤0.0300%.

TABLE 1

| Raw material | C | Si | Mn | P | S | Cr | Mo | V | Zn | mass % Fe※ |
|---|---|---|---|---|---|---|---|---|---|---|
| A | 0.37 | 1.03 | 0.43 | 0.009 | 0.0017 | 5.13 | 1.25 | 0.82 | — | Bal. |
| B | 0.37 | 1.03 | 0.44 | 0.021 | 0.0021 | 5.25 | 1.23 | 0.82 | — | Bal. |
| C | 0.38 | 1.02 | 0.43 | 0.021 | 0.0019 | 5.14 | 1.24 | 0.82 | 0.0130 | Bal. |
| D | 0.37 | 1.00 | 0.45 | 0.025 | 0.0022 | 5.04 | 1.17 | 0.81 | 0.0120 | Bal. |

※Impurities are included.

These raw materials were subjected to homogenizing treatment at 1250° C. for 10 hours. Then, these homogenized raw materials were heated to a temperature of 1150° C., which was a typical hot working temperature for hot-working tool steels, and the heated raw materials was subjected to hot working. In this regard, a processing ratio (cross-sectional area ratio) during hot working was set to solid forging of 2S; reheating was not performed during hot working; and the hot working was finished in an actual working time of 5 minutes. Moreover, in another hot working, the processing ratio (cross-sectional area ratio) during hot working was set to solid forging of not less than 7S; reheating was not performed during hot working; and the hot working was finished in an actual working time of 5 minutes.

Then, the hot worked steel materials were subjected to annealing at 860° C. to produce hot-working tool materials A1, B1, C1, and D1, for which the processing ratio during the above described hot working was 2S, and hot-working tool materials A2, B2, C2, and D2, for which the same processing ratio was not less than 7S. Then, these hot-working steel materials A1 to D1 and A2 to D2 were subjected to quenching from 1030° C. and tempering at 630° C. (target hardness 43 HRC) to produce hot-working tools A1 to D1 and A2 to D2 having a martensitic structure.

A Charpy impact test specimen (L direction, 2 mm U-notch) was sampled from each of the hot working tools A1 to D1 and A2 to D2 and was subjected to a Charpy impact test. Then, prior austenite grain diameters in the structure of these Charpy impact test specimens were measured in the grain size number according to JIS-G-0551 (ASTM-E112).

Moreover, P concentration at prior austenite grain boundaries (grain boundary P concentration) of these hot-working tools were measured by an Field Emission Auger Electron Spectroscopy (FE-AES) apparatus. First, a specimen of a diameter 3.0 mm×length 20.0 mm was sampled from each of the above described hot-working tools A1 to D1 and A2 to D2. A "notch" having a depth of 0.5 mm was machined in the peripheral part of this specimen. Next, this specimen was cooled to −196° C. with liquid nitrogen in the FE-AES apparatus which was kept in high vacuum, and was broken to generate an intergranular fracture. Then, a position where a fracture at a prior austenite grain boundary had occurred was selected from the broken-out surface where an intergranular fracture was generated, and an Auger electron spectrum of a region having an area of 3 μm×3 μm was acquired. From the acquired Auger electron spectrum, a P concentration was quantitatively analyzed to obtain a grain boundary P concentration. Analysis results of grain boundary P concentration are shown in Table 2.

TABLE 2

| Tool | Raw material | Grain size number | Grain boundary P concentration (mass %) | Charpy impact value ($J/cm^2$) | Remarks |
|---|---|---|---|---|---|
| A1 | P: 0.009% | 7.5 | 0.79 | 73.1 | Conventional example |
| B1 | P: 0.021% | 7.0 | 2.28 | 64.3 | Comparative example |
| C1 | P: 0.021%, Zn: 0.0130% | 8.0 | 1.55 | 68.7 | |
| D1 | P: 0.025%, Zn: 0.0120% | 7.5 | 2.26 | 59.6 | |
| A2 | P: 0.009% | 10.0 | 0.35 | 100.8 | |
| B2 | P: 0.021% | 9.5 | 0.78 | 72.0 | Example according to the invention |
| C2 | P: 0.021%, Zn: 0.0130% | 10.0 | 0.87 | 81.5 | |
| D2 | P: 0.025%, Zn: 0.0120% | 10.0 | 0.93 | 79.5 | |

Hot-working tool A1 was a conventional hot-working tool. Its P content was reduced to less than 0.010% in consideration of deterioration of toughness, and its Charpy impact value was not less than 70 $J/cm^2$. Hot-working tool A2 was also a hot-working tool whose P content was reduced to less than 0.010%. Reducing P content of a hot-working tool requires significant energy. In contrast to these hot-working tools, hot-working tools B1, C1, and D1 were each a hot-working tool in which the P content of hot-working tool A1 was increased to more than 0.020%. As the P content increased, the grain boundary P concentration increased and the Charpy impact value decreased to less than 70 $J/cm^2$.

Hot-working tool B2 was a hot-working tool of the present invention, in which the P-content was the same as that of hot-working tool B1, and the prior-austenite grain diameter was reduced to No. 9.5 in the grain size number. The grain boundary P concentration thereof decreased to a level of conventional hot-working tool A1, and the Charpy impact value increased to not less than 70 $J/cm^2$. Moreover, hot-working tools C2 and D2 were each also a hot-working tool of the present invention, in which the P contents thereof were the same as those of hot-working tools C1 and D1, respectively, and the prior austenite grain diameters were reduced to not less than No. 9.5 in the grain size number. As for hot-working tool B2, as a result of including a proper amount of Zn and in conjunction with the effect of the above described reduction of the grain boundary P concentration, the Charpy impact value increased to about 80 $J/cm^2$.

Figure 2:
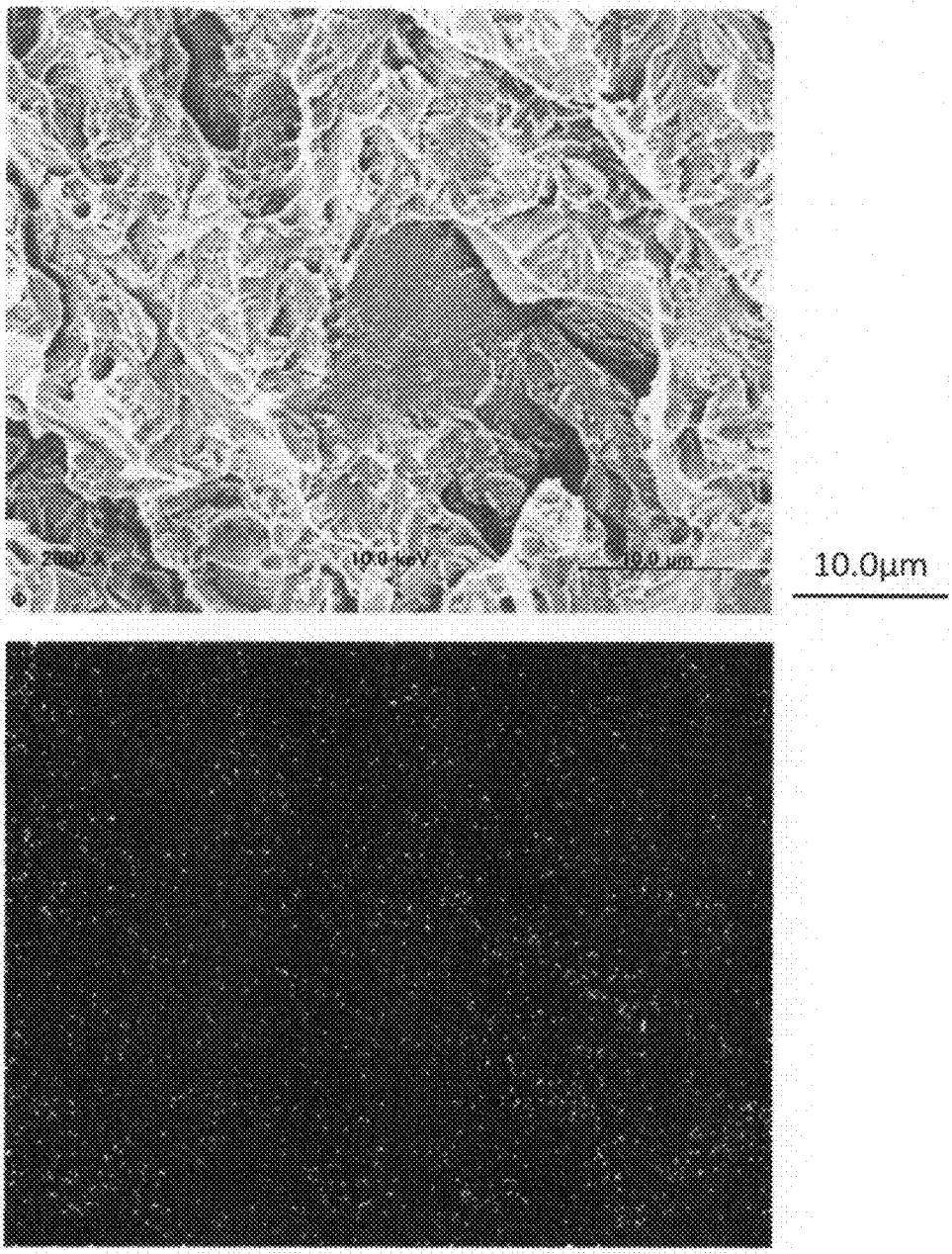
FIG. 2 is an element mapping diagram showing a scanning electron microscopic image of a broken-out surface structure of hot-working tool A1 evaluated in Example, and P concentration in this image.
Figure 3:
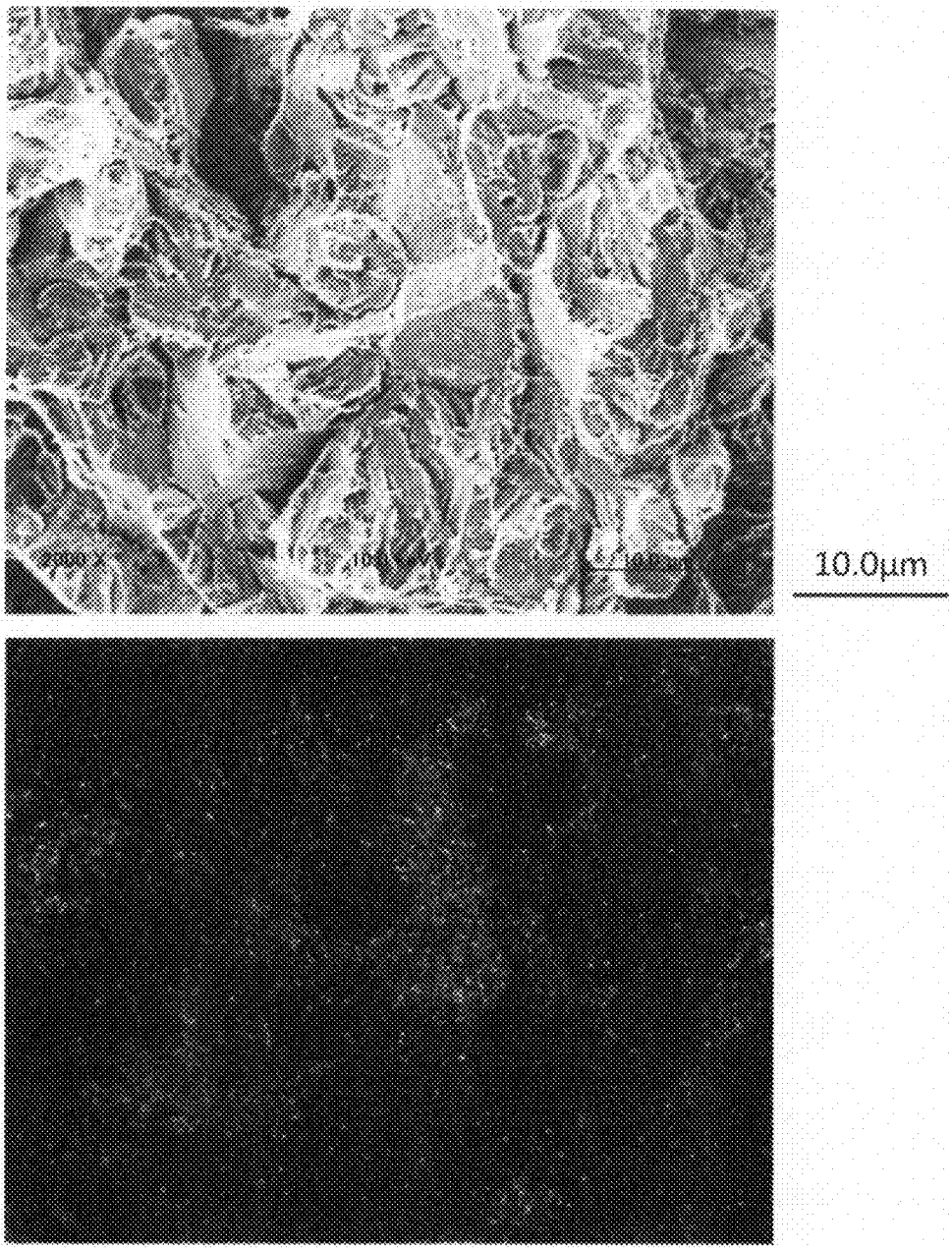
FIG. 3 is an element mapping diagram showing a scanning electron microscopic image of a broken-out surface structure of hot-working tool B1 evaluated in Example, and P concentration in this image.

As an example of the above described broken-out surface where the grain boundary P concentration was analyzed, an image of a broken-out surface of hot-working tool A1 observed by a scanning electron microscope (magnification of 2000), and an element mapping diagram showing P concentration in that image are shown in FIG. 2. Moreover, an image of a broken-out surface of hot-working tool B1 observed by a scanning electron microscope (magnification of 2000), and an element mapping diagram showing P concentration in that image are shown in FIG. 3.

In a scanning electron microscopic image in the upper side of each figure, a portion of smooth broken-out surface corresponds to an "intergranular fracture part (prior austenite grain boundary)". Further, in an element mapping diagram in the lower side of each figure, a portion indicated by a white spot is a "portion where P element is concentrated (high P concentration portion)". (Note that actually the element mapping diagram is shown in color. In the actual element mapping diagram, the above described portion where P element is concentrated is indicated by a region of red color including a portion of a white spot.) In comparison between FIG. 2 and FIG. 3, it is seen that P element is significantly concentrated and thus the grain boundary P concentration is high in the intergranular fracture part of FIG. 3 (hot-working tool B1). In hot-working tool B2 of the present invention in which the prior austenite grain diameter of FIG. 3 is reduced, the grain boundary P concentration in the broken-out surface decreased to the level of FIG. 2 (hot-working tool A1).

The invention claimed is:

1. A hot work tool having a quenched and tempered martensitic structure, the tool having a composition comprising, by mass, 0.30 to 0.50% of carbon,
not more than 2.00% of silicon,
not more than 1.50% of manganese,
more than 0.020% and not more than 0.050% of phosphorus,
not more than 0.0500% of sulfur,
3.00 to 6.00% of chromium,
one or both of molybdenum and tungsten in an amount of (Mo+½W): 0.50 to 3.50%,
0.10 to 1.50% of vanadium, and
0 to 1.00% of nickel,
0 to 1.00% of cobalt,
0 to 0.30% of niobium, and
the balance of iron and impurities,
wherein prior austenite crystal in the quenched and tempered martensitic structure has a grain size of not less than No. 9.5 as a grain size number pursuant to JIS-G-0551, and
wherein a phosphorus concentration at grain boundaries of the prior austenite crystal is not more than 1.5 mass %.

2. The hot work tool according to claim 1, wherein the composition further includes not more than 0.0250 mass % of zinc.

3. The hot work tool according to claim 1, wherein the carbon content is 0.34 to 0.50%.

4. A method for manufacturing a hot work tool having a martensitic structure, comprising subjecting a raw material to homogenizing treatment and solid forging to produce a steel material, subjecting the steel material to annealing to produce a hot work tool material, and quenching and tempering the hot work tool material having a composition comprising, by mass, 0.30 to 0.50% of carbon,
not more than 2.00% of silicon,
not more than 1.50% of manganese,
more than 0.020% and not more than 0.050% of phosphorus, not more than 0.0500% of sulfur, 3.00 to 6.00% of chromium, one or both of molybdenum and tungsten in an amount of (Mo+½W): 0.50 to 3.50%, 0.10 to 1.50% of vanadium, and 0 to 1.00% of nickel, 0 to 1.00% of cobalt, 0 to 0.30% of niobium, and the balance of iron and impurities, wherein the homogenizing treatment is performed at a temperature of 1200 to 1350° C. for not less than 10 hours, wherein the solid forging is performed with a processing ratio of not less than 7S, wherein prior austenite crystal in the quenched and tempered martensitic structure has a grain size of not less than No. 9.5 as a grain size number pursuant to JIS-G-0551, and wherein a phosphorus concentration at grain boundaries of the prior austenite crystal is not more than 1.5 mass %.

5. The method according to claim 4, wherein the composition of the material further includes not more than 0.0250 mass % of zinc.

6. The method according to claim 4, wherein the carbon content is 0.34 to 0.50%.

* * * * *